US005984709A

United States Patent [19]

Zink et al.

[11] Patent Number: 5,984,709

[45] Date of Patent: Nov. 16, 1999

[54] ELECTRIC CONNECTOR

[75] Inventors: Markus Zink, Stuttgart; Markus Cech, Ostfildern; Frank Andrä , Deizisau, all of Germany

[73] Assignee: Contact GmbH Elektrische Bauelemente, Stuttgart, Germany

[21] Appl. No.: 08/994,492

[22] Filed: Dec. 19, 1997

[30] Foreign Application Priority Data

Dec. 18, 1996 [DE] Germany ..... 196 52 838

[51] Int. Cl.[6] ..... H01R 4/50

[52] U.S. Cl. ..... 439/348

[58] Field of Search ..... 439/125–128, 439/312–313, 345–349, 352, 358

[56] References Cited

U.S. PATENT DOCUMENTS

| | | | |
|---|---|---|---|
| 2,521,701 | 9/1950 | Earle et al. | 439/348 X |
| 3,237,147 | 2/1966 | Elliott et al. | 439/348 |
| 5,807,129 | 9/1998 | Konda et al. | 439/348 |

FOREIGN PATENT DOCUMENTS

| | | | |
|---|---|---|---|
| 0 532 955 A2 | 3/1993 | European Pat. Off. | H01R 13/639 |
| 2337952 | 8/1977 | France | 439/348 |
| 39 28 710 A1 | 3/1991 | Germany | H01R 13/639 |
| 195 21 754 A1 | 12/1996 | Germany | H01R 13/639 |

*Primary Examiner*—Khiem Nguyen
*Attorney, Agent, or Firm*—Havverstock & Owens LLP

[57] ABSTRACT

A connector of an electric connector coupling has a guide sleeve and at least one engagement element that can be moved between a locking position and a releasing position, as well as a gripping sleeve which, in a first position locks the at least one engagement element in its locking position, and in a second position allows the at least one engagement element to be moved into its releasing position. The connector has been further developed in that the gripping sleeve is capable of occupying a third position, wherein the at least one engagement element is urged with a predetermined force into its locking position. Moreover, an electric connector coupling has such a connector and a matching coupler. The connector can be easily pushed onto the coupler and be pulled off therefrom, and is securely held on the coupler in its fitted state.

10 Claims, 6 Drawing Sheets

ELECTRIC CONNECTOR

FIELD OF THE INVENTION

The invention concerns a connector of an electric connector coupling. Such a connector of an electrical connector coupling, has a guide sleeve which has an internal surface, at least one engagement element that can be moved between a locking position wherein it projects inwards from the internal surface of the guide sleeve and a releasing position wherein it does not project inwards beyond the internal surface, and a gripping sleeve displaceable relative to the guide sleeve, wherein the gripping sleeve in a first position locks the at least one engagement element in its locking position, in a second position allows the at least one engagement element to be moved into its releasing position, and is capable of occupying a third position, wherein the at least single engagement element is urged into its locking position. The invention also relates to an electric connector coupling.

PRIOR ART

In this context, "connector" is understood to mean any component which is arranged to be fitted on a matching coupler, irrespective as to whether the connector is provided with electric contact elements or receiving means for such contact elements, or whether it is merely arranged for receiving a contact module.

EP-A-0 532 955 shows a catch fastener with a locking means for HF coaxial plug connectors of the above stated type. In this plug connector, a gripping sleeve is provided which can be displaced from a spring-loaded central rest position in both axial directions. In the rest position of the gripping sleeve, an engagement element arranged in the guide sleeve is locked in a locking position, whilst in the two axial positions of the gripping sleeve displaced relative to the rest position, the engagement elements can be freely moved in the radial direction.

DE-A-195 21 754 discloses a connector coupler according to the push-pull system, wherein a locking sleeve is provided with axially projecting locking claws, each having an engagement face. This locking sleeve permits the release of the connector component in the case of any suddenly increasing high forces, in the sense of an emergency release.

DE-A-39 28 710 discloses an electric connector coupling wherein a locking element of a first connecting element engages in a locking position behind a shoulder of a second connecting element. By the displacement of an axial slide, the locking element can be brought into an unlocking position releasing the shoulder. But in this connector coupling a relatively high force has to be exerted in order to fit together the two connecting elements, since the axial slide is then situated in its rest position, and the locking element has first to be urged into its releasing position against the action of a spring arrangement by means of lead-in ramps which are disposed on one of the connecting elements.

OBJECTS OF THE INVENTION

Accordingly, it is the object of the invention to provide a connector of an electric connector coupling that can be easily fitted on a coupler and can be easily pulled off therefrom and which in its fitted state is securely held on the coupler. At the same time, the risk of any operating error or a faulty engagement is to be kept as low as possible. The connector should be easy and inexpensive to make.

It is a further object of the invention to provide a corresponding connector coupling.

SUMMARY OF THE INVENTION

In accordance with a first aspect of the invention, there is provided a connector of an electrical connector coupling, having a guide sleeve which has an internal surface, at least one engagement element that can be moved between a locking position wherein it projects inwards from the internal surface of the guide sleeve and a releasing position wherein it does not project inwards beyond the internal surface, and a gripping sleeve displaceable relative to the guide sleeve, wherein the gripping sleeve in a first position locks the at least engagement element in its locking position, in a second position allows the at least one engagement element to be moved into its releasing position, and is capable of occupying a third position, wherein the at least single engagement element is urged into its locking position, and wherein in the third position of the gripping sleeve the at least one engagement element bears on an elastic element arranged in the gripping sleeve, so that the at least single engagement element is urged with a predetermined force into its locking position by the elastic element.

A second aspect of the invention provides an electric connector coupling having a connector according to the first aspect, and a coupler which has at least one engagement structure in which the at least single engagement element of the connector is capable of engaging in its locking position.

While being fitted on the coupler, the connector in accordance with the invention is held at the gripping sleeve. This ensures correct handling, without the risk that the electric cable connected to the connector will be subjected to mechanical stresses. The gripping sleeve can occupy a position wherein the at least one engagement element is urged into a locking position only with a predetermined, preferably low, force. The connector can then be easily pushed onto the coupler. The gripping sleeve can, moreover, occupy a position wherein the at least one engagement element is locked in its locked position and the connector is thus reliably held on the coupler.

The different positions of the gripping sleeve preferably correspond to different axial displacement positions of the gripping sleeve on the guide sleeve. In this arrangement, the first position is preferably the rest position; the second position corresponds to a pulled back gripping sleeve (as obtained when the connector is gripped at the gripping sleeve and is pulled off from the coupler) and the third position corresponds to a pushed-forward gripping sleeve (as obtained when the connector is gripped at the gripping sleeve and is fitted on the coupler).

The connector can be particularly easily pulled out of the coupler (after the release by the displacement of the gripping sleeve into its second position) if the at least one engagement element is freely displaceable in this position. This means in particular, that is not subjected to any force urging it into its locking position.

The gripping sleeve is preferably formed as a single component (if applicable, with the exception of an elastic element and other small components).

In a preferred embodiment, the gripping sleeve is held in its first position as the rest position by two compression springs disposed with an axial interspacing from each other.

The electric connector coupling in accordance with the invention comprises the connector as well as a coupler which is capable of cooperating with the connector. The coupler can be used in a particularly versatile manner if it has, apart from at least one engagement structure for the connector in accordance with the invention, at least one further guide means for locking pins of a bayonet connector.

BRIEF DESCRIPTION OF THE DRAWINGS

An example of the embodiment of the invention will now be described in greater detail with reference to the attached drawings, in which.

DETAILED DESCRIPTION OF THE PREFERRED EMBODIMENT

Figure 1:
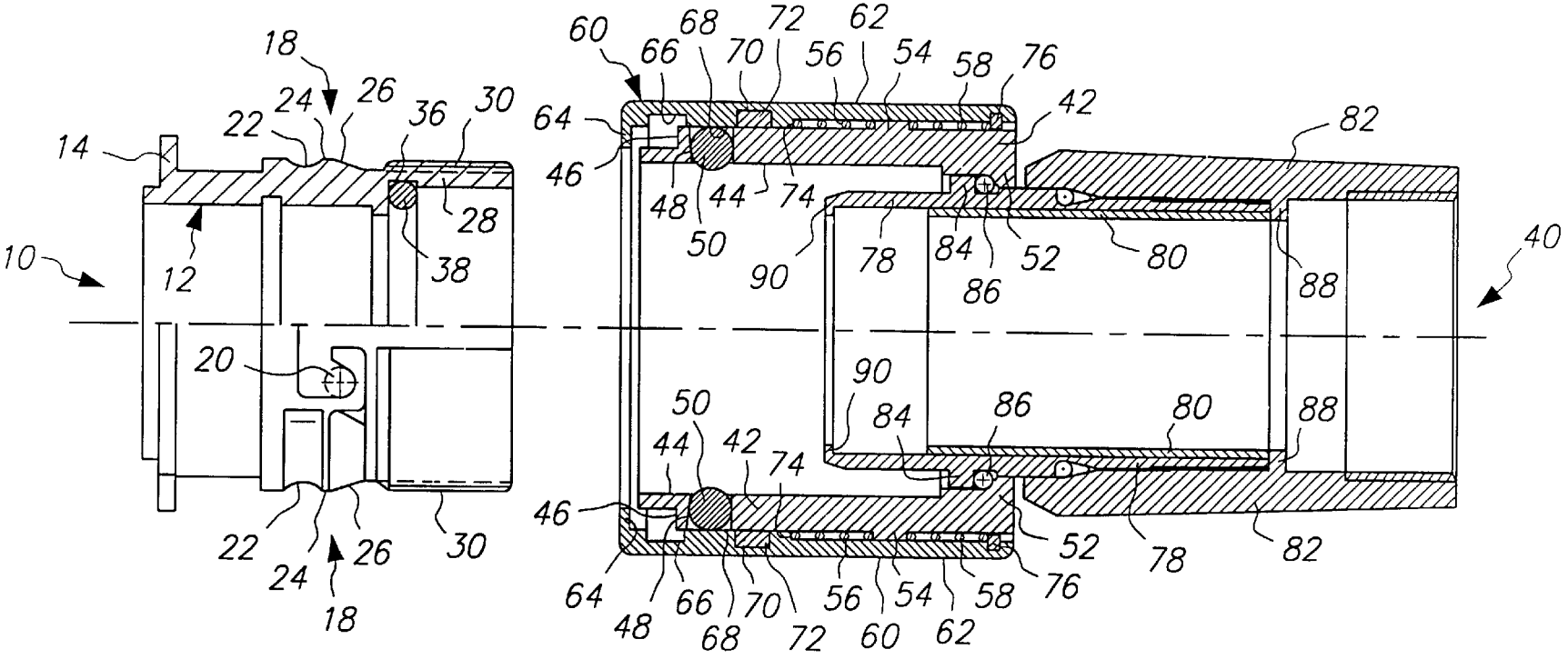
FIG. 1 is a sectional view of the connector coupling in accordance with the invention, wherein the connector and coupler are shown separately.
Figure 2:
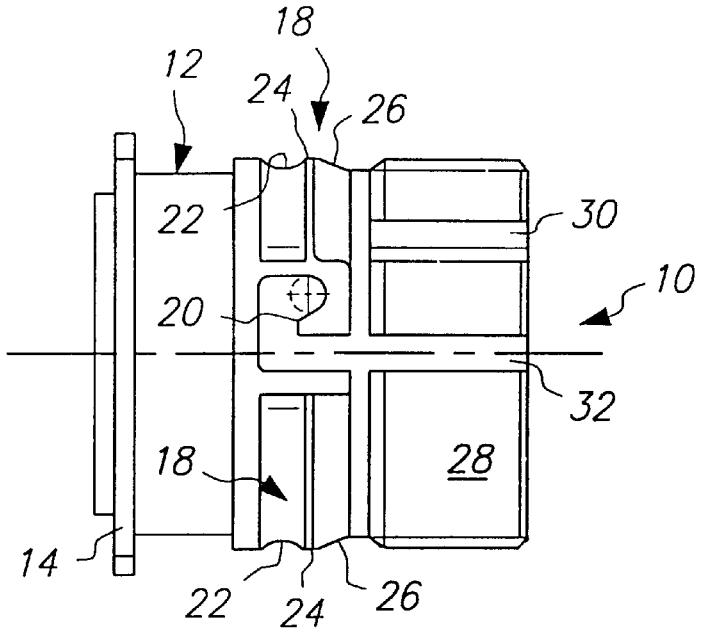
FIG. 2 and FIG. 3 are a side view and front view, respectively, of the coupler.
Figure 3:
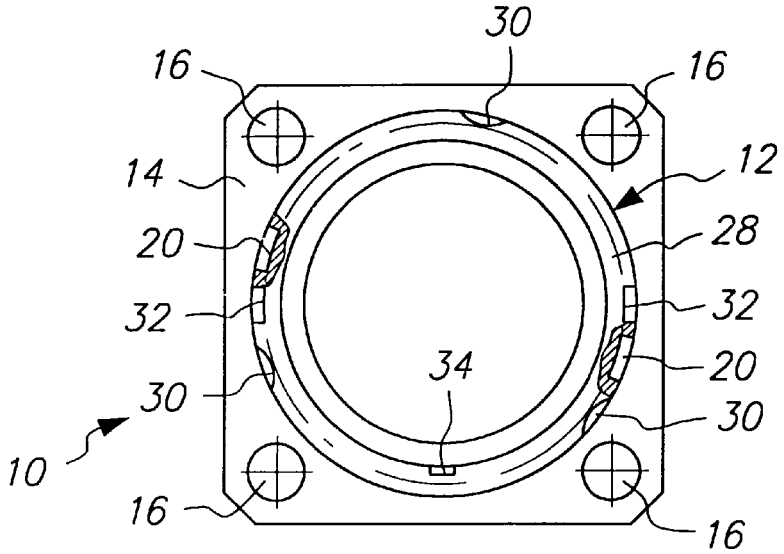

The coupler 10 shown on the left in FIG. 1 as well as in FIGS. 2 and 3, has as its main component an approximately cylindrical coupler body 12. At one end of the coupler body 12 there is provided a square mounting flange 14 with four holes 16, one in each corner (FIG. 3). The coupler body 12 can be attached by means of the mounting flange 14, for example on the casing of an appliance.

Approximately at the centre of its axial length, the coupler body 12 has two engagement structures 18 which extend on the outer surface of the coupler body 12 through approximately 160° and which are offset with respect to each other by 180°. The engagement structures 18 are separated by two J-shaped guide means and engagement means 20 for the pins of a bayonet connector. Because of this, it is possible to use the coupler 10 both with the connector 40 (FIG. 1) in accordance with the invention and with a bayonet connector known per se.

In its peripheral reach, each engagement structure 18 has an approximately constant profile. In the viewing direction, starting from the mounting flange 14, there is first of all arranged an engagement flute 22 with an approximately circular arcuate profile. This flute is separated by a narrow ridge 24 from a lead-in ramp 26. At the side facing the mounting flange 14, the lead-in ramp 26 passes continuously into the ridge 24 and then forms a section of a conical wall with a constantly reducing radius.

The end of the coupler body 12 remote from the mounting flange 14 is formed by a cylindrical coupling ring 28. On its external side, the coupling ring 28 has three grooves 30, with a circular arcuate cross-section which extend in the axial direction and respectively offset by 120°, and two straight guide means 32 that also extend axially of the coupling ring 28 and which are extended in the J-shaped guide means 20. A straight axial coding groove 34 (FIG. 3) is arranged on the internal side of the coupling ring 28. A sealing ring 38 is, moreover, inserted into a groove 36 which is situated on the internal side of the coupler body 12 at the internal end of the coupling ring 28.

The connector 40 shown on the right in FIG. 1 has a guide sleeve 42 with an approximately cylindrical internal surface 44 which delimits a cavity open towards the left side. This cavity is capable of accommodating the coupler body 12 in which arrangement, a coding ridge (not shown) of the guide sleeve 42 engages in the coding groove 34 of the coupling ring 28. By this means, one ensures the correct alignment of the terminal layouts which are arranged in the coupler 10 and the connector 40.

The guide sleeve 42 has a front edge 46 of a reduced thickness. In the vicinity of the front edge 46, shown on the left in the Figures, three recesses 48 respectively offset by 120° are provided in the guide sleeve 42, which serve as a bearing means for one engagement element 50 each. In the present example of the embodiment, the engagement elements 50 are formed as ball catches. The rear edge of the guide sleeve 42 has an inwardly directed flange 52. Moreover, a peripheral collar 54 is formed on the external side of the guide sleeve 42, between its centre and its rear edge, this collar serves as a bearing means for a first compression spring 56 and a second compression spring 58.

A gripping sleeve 60 surrounds the guide sleeve 42 and can be axially displaced thereon. The gripping sleeve 60 is approximately cylindrical and has on its outside a suitably formed gripping surface 62.

At its front end shown on the left in the Figures, an annular inwardly directed projection 64 is formed, which is capable of coming to bear on the front edge 46 of the guide sleeve 42.

The projection 64 is followed on the inner side of the gripping sleeve 60 by a first annular recess 66 which has a rectangular cross-section. Following the first recess 66, there is formed a straight blocking face 68 and following that, a second recess 70 that is also annular. The second recess 70 is filled by an annular elastic element 72 which is formed as a ring-formed elastomer (for example, Perbunan), with a low hardness (between 20 and 40 Shore and preferably approximately 30 Shore on the Shore A scale).

The two compression springs 56 and 58 are each located in a respective narrow cavity, formed between the gripping sleeve 60 and the guide sleeve 42. In this arrangement, the first compression spring 56 is inserted between a shoulder 74 of the gripping sleeve 60 and the collar 54 of the guide sleeve 42, and the second compression spring 58 is inserted between the collar 54 and a securing ring 76 which, for its part, is inserted in a suitable groove near the rear edge of the gripping sleeve 60, and projects inwardly. The prestressing of the two compression springs 56 and 58 is the same so that, in the rest position of the connector 40 shown in FIG. 1, the engagement elements 50 bear on the blocking face 68 and are blocked by it in their locking position, wherein they project inwards beyond the internal side 44 of the guide sleeve 42.

The connector 40 has, moreover, an inner sleeve 78, an internal insulating sleeve 80 and an outer sleeve 82. The inner sleeve 78 is inserted from the front into the guide sleeve 42. A section of the inner sleeve 78 projecting rearwards from the guide sleeve 42 is provided with an external thread onto which the outer sleeve 82 is screwed by means of a corresponding internal thread. The inner sleeve 78 is secured against slipping out of the guide sleeve 42 towards the rear, in that its bears with a peripheral projection 84 on the rear flange 52 of the guide sleeve 42 with the interposition of an O-ring 86.

The internal insulating sleeve 80 is inserted into the inner sleeve 78. The rear edges of the inner sleeve 78 and of the insulating sleeve 80 bear on an inner projection 88 of the outer sleeve 82. A contact module of the connector 40, not shown in the Figures, is inserted between a front inward projection 90 of the inner sleeve 78 and a front edge of the internal insulating sleeve 80.

All parts of the coupler 10 and of the connector 40 consist selectably of metal or of a suitable plastic material. In alternatives of the embodiment, it is possible to use more, or fewer, engagement elements 50. The coupler 10 too can have an inner sleeve, an insulating sleeve and an outer sleeve, like the connector 40, instead of being designed as an add-on part.

The structural shape of the connector 40 may, moreover, be shortened if, instead of the two compression springs 56 and 58 it has only a single compression spring which bears at its two ends both on a shoulder of the guide sleeve 42 and on a shoulder of the gripping sleeve 60 respectively. In the rest position of the gripping sleeve 60 the two shoulders of the guide sleeve 42 and of the gripping sleeve 60 are aligned flush with one another at each end of the single compression spring. During each displacement of the guide sleeve 42 and of the gripping sleeve 60 with respect to one another, the single compression spring is compressed, so that it urges the two sleeves back into their rest position.

Figure 4:
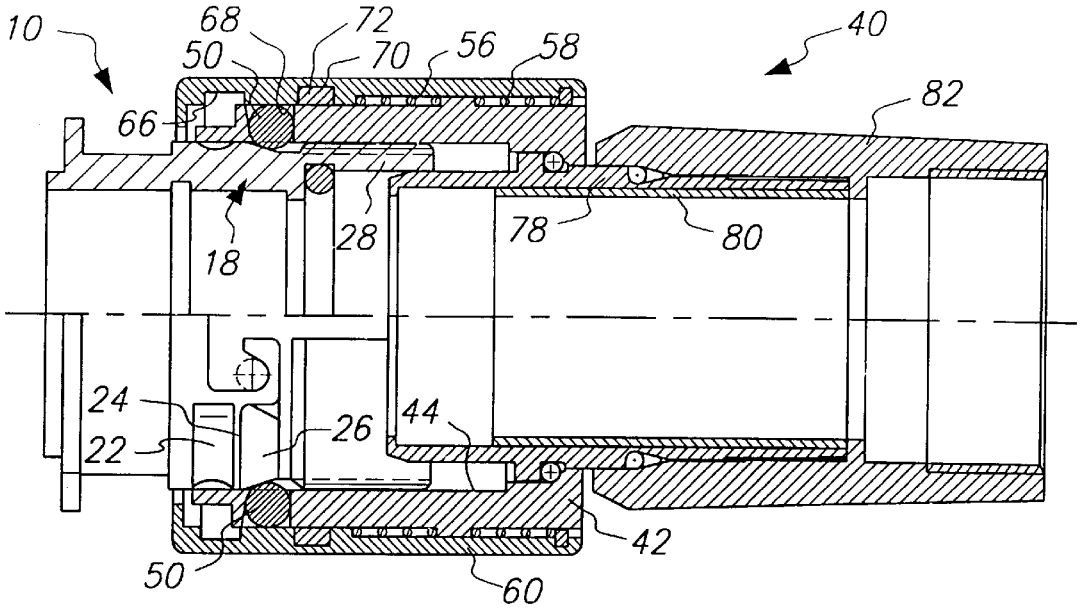
FIG. 4 is a first sectional view of the connector of the preferred embodiment.

During the assembly of the connector coupling, the connector 40 is first aligned with the coupler 10 as regards its rotational position, in such a way that the coding ridge (not shown) of the connector 40 is capable of engaging in the coding groove 34 of the coupler 10. In this rotational position, the engagement elements 50 are also aligned with the groove 30 of the coupler 10. Now if the connector 40 is gripped by the gripping sleeve 60 and is pushed onto the coupler 10, the coupling ring 28 passes the engagement elements 50 without any resistance, until the arrangement shown in FIG. 4 has been reached. The engagement elements 50 are here disposed in contact with the lead-in ramps 26 and are pressed outwards by them. Since, however, the engagement elements 50 are prevented by the blocking faces 68 from being deflected outwards, it is not possible to push the connector 40 on any further without exerting any force.

Figure 5:
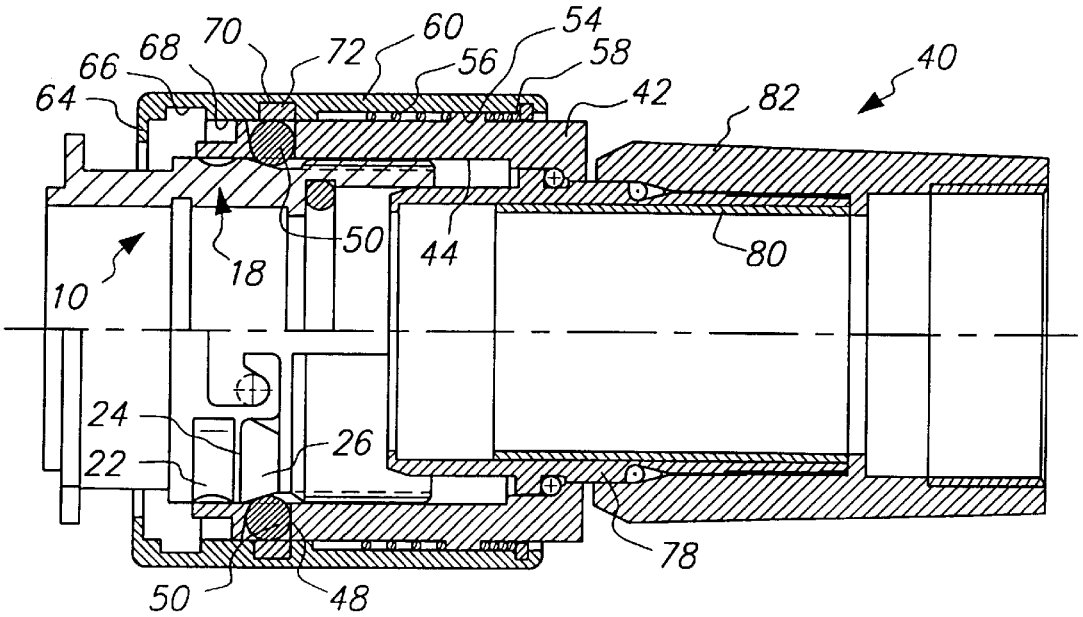
FIG. 5 is a second sectional view of the connector of the preferred embodiment.

Now if a force is exerted on the gripping sleeve 60 in the forward direction, i.e. directed towards the coupler 10, in order to push on the connector 40 further, the gripping sleeve 60 at first moves forward (towards the coupler 10) against the resistance of the second compression spring 58, until it has reached its third position shown in FIG. 5. The second recess 70 of the gripping sleeve 60, filled with the elastic element 72 is now aligned with the engagement elements 50.

Figure 6:
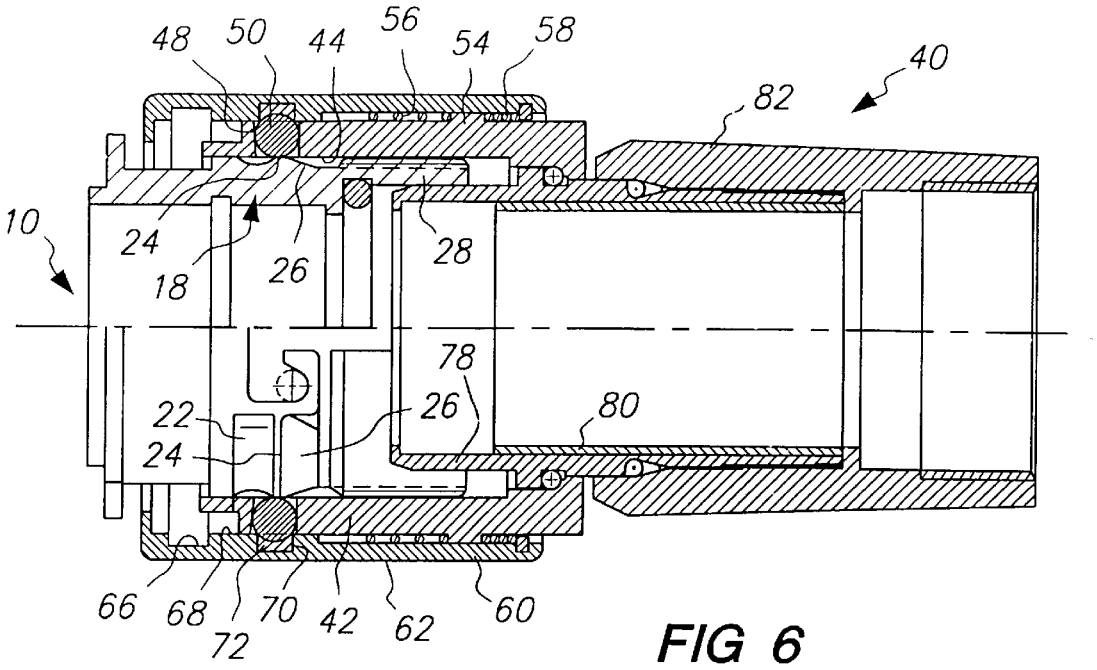
FIG. 6 is a third sectional view of the connector of the preferred embodiment.

When the connector 40 is pushed on further, the engagement elements 50, which are being urged outwards by the lead-in ramps 26, are pressed outwardly into the elastic element 72. In FIG. 6, the engagement elements 50 have reached the height of the ridge 24. They are now pressed into the elastic element 72 to the maximum extent.

Figure 7:
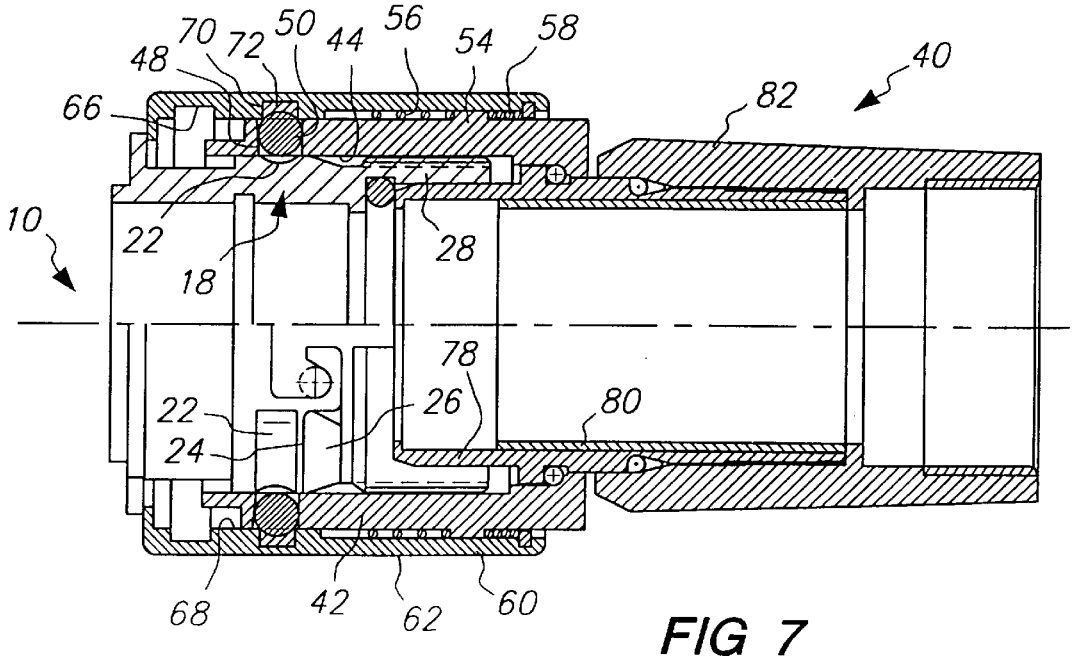
FIG. 7 is a fourth sectional view of the connector of the preferred embodiment.

While so far the spring force of the elastic element 72 had to be overcome by the connector 40 being pushed on, the connector 40 can now be easily pushed into its final position shown in FIG. 7, wherein the engagement elements 50 are aligned with the engagement flutes 22. The stressing of the second compression spring 58 also contributes to this effect.

Figure 8:
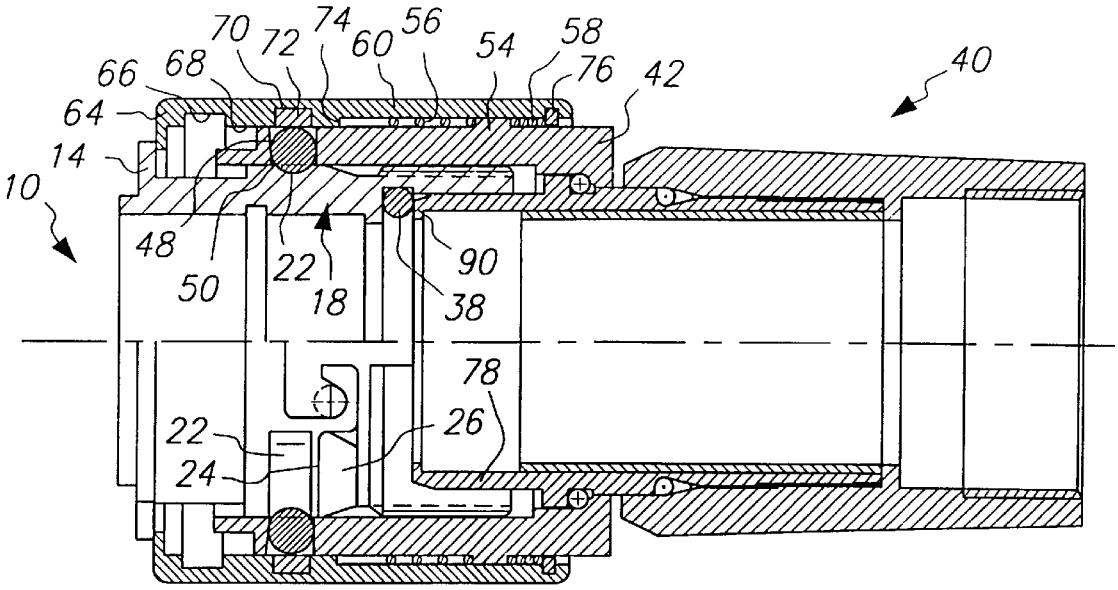
FIG. 8 is a fifth sectional view of the connector of the preferred embodiment.

The engagement elements 50 are now moved by the relaxing elastic element 72 into their locking position in the engagement flutes 22. For this purpose the elastic element 72 only has to exert slight force, because the engagement elements 50 are capable of freely moving in the recesses 48. FIG. 8 shows the configuration obtained in this way.

Figure 9:
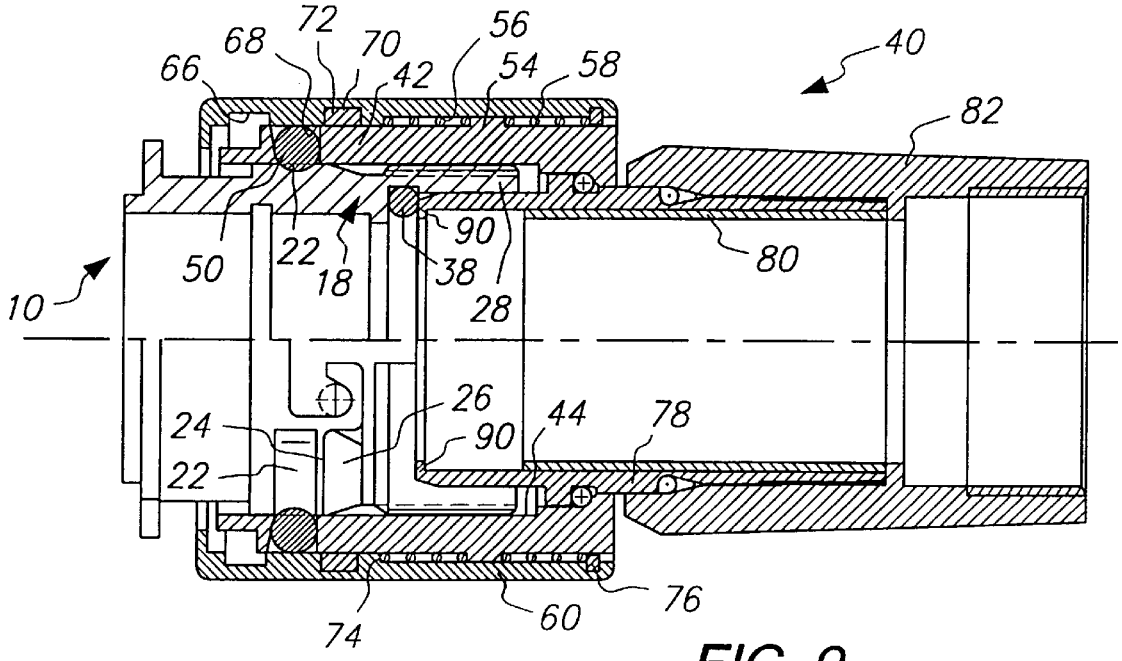
FIG. 9 is a sixth sectional view of the connector of the preferred embodiment.

Now when the gripping sleeve 60 is released it moves, under the action of the second compression spring 58, into its first position (its rest position). The position of the engagement elements 50 is not altered, since the inner face of the relaxed elastic element 72 terminates flush with the blocking face 68. The engagement elements 50 are thereby held by the blocking face 68 in their position engaging in the engagement flutes 22. The connector 40 is now locked with a form fit on the coupler 10, as shown in FIG. 9.

In this locked position of the connector coupling, the coupling ring 28 engages between the guide sleeve 42 and the front section of the inner sleeve 78. The two contact modules installed in the connector 40 or in the coupler 10 produce the desired electrical contact. The front projection 90 of the inner sleeve 78 bears with pressure on the sealing ring 38 of the coupler 10, to ensure a sufficient IP seal of the connector coupling.

Figure 10:
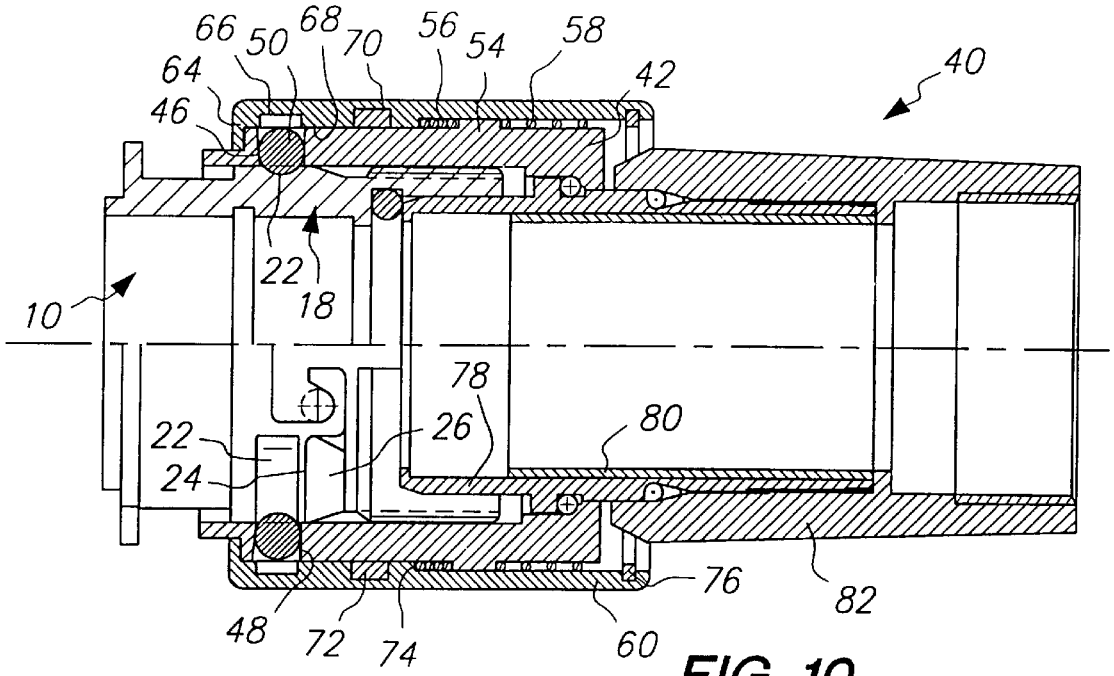
FIG. 10 is a seventh sectional view of the connector of the preferred embodiment.

For releasing the connector coupling, the connector 40 is gripped by the gripping sleeve 60 and is pulled rearwards (away from the coupler 10). Since the engagement elements 50 are still holding the connector 40 on the coupler 10, it is at first only the gripping sleeve 60 that moves rearwards, whereby the first compression spring 56 is being compressed (see FIG. 10). The front projection 64 of the gripping sleeve 60 bears on the front edge 46 of the guide sleeve 42 and thus limits the rearward displacement of the gripping sleeve 60. The first recess 66 of the gripping sleeve 60 is aligned with the engagement elements 50, so that the elements 50 can be moved from their locking position where they engage in the engagement flutes 22, into their releasing position where they partly penetrate into the first recess 66. The engagement elements 50 are capable of free axial movement; in particular, no force is acting on them which would urge them into the engagement flutes 22.

Figure 11:
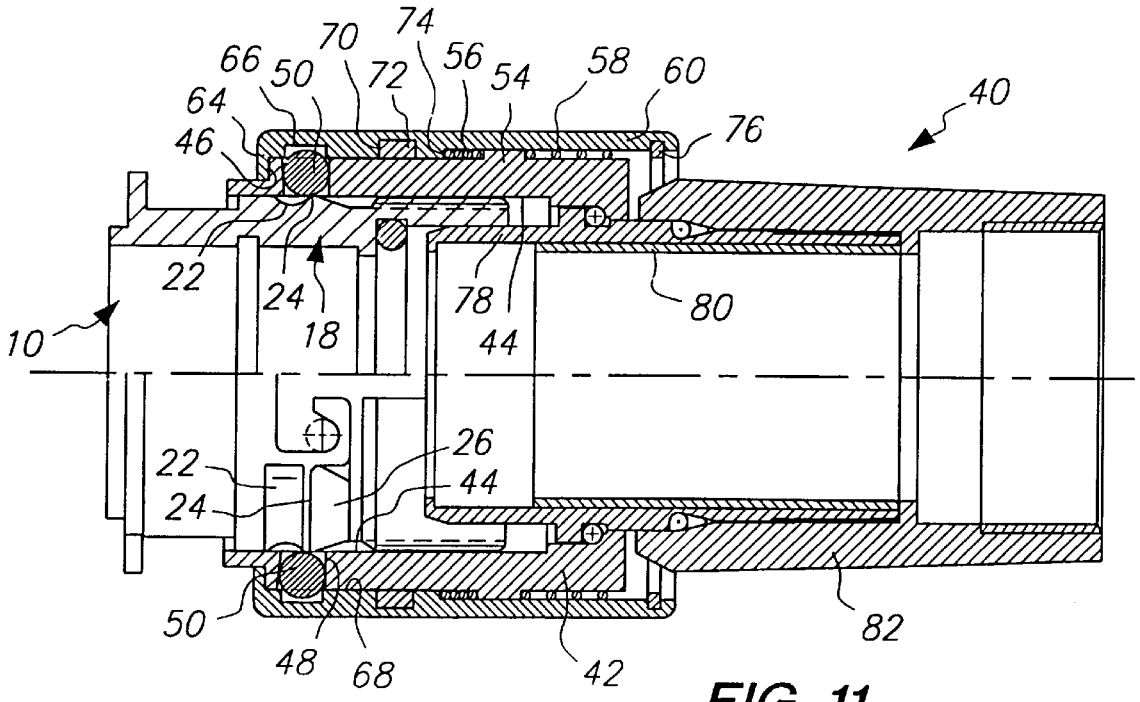
FIG. 11 is an eighth sectional view of the connector of the preferred embodiment.

If the connector 40 is now pulled rearwards the wedge action of the engagement flutes 22, which have a circular arcuate profile, urges the engagement elements 50 into their releasing position, wherein they do not project inwards (or do so only slightly) beyond the internal side 44 of the guide sleeve 42. FIG. 11 shows how the engagement elements have reached the releasing position and are situated at the level of the ridge 24. The connector 40 is now no longer joined to the coupler 10 with a form fit. It can be easily pulled off.

We claim:

1. A connector of an electrical connector coupling, having a. a guide sleeve which has an internal surface;

b. at least one engagement element that is moveable between a locking position wherein the engagement element projects inwards from the internal surface of the guide sleeve and a releasing position wherein the engagement element does not project inwards beyond the internal surface; and c. a gripping sleeve having an elastic element and is displaceable relative to the guide sleeve, wherein the gripping sleeve in a first position locks the engagement element in the locking position, in a second position allows the engagement element to be moved into the releasing position, and is moveable to a third position, wherein the engagement element is urged into the locking position, wherein while in the third position, the engagement element bears on the elastic element arranged in the gripping sleeve, so that the engagement element is urged with a predetermined force into the locking position by the elastic element.

2. The connector according to claim 1, wherein the first, second, and third positions of the gripping sleeve correspond to different axial displacement positions of the gripping sleeve on the guide sleeve, and wherein the first position lies between the second and the third positions.

3. The connector according to claim 1, wherein while in the first position of the gripping sleeve, the engagement element in the locking position bears on a blocking face of the gripping sleeve.

4. The connector according to claim 1, wherein while in the second position of the gripping sleeve, the engagement element penetrates at least partly into a recess of the gripping sleeve.

5. The connector according to claim 1, wherein while in the second position of the gripping sleeve, the engagement element freely moves between the locking position and the releasing position by a spring force acting thereon.

6. The connector according to claim 1, wherein the elastic element is arranged in a recess of the gripping sleeve and consists of an elastomer with a Shore scale A hardness between 20 and 40.

7. The connector according to claim 1, wherein if no external forces are acting on the griping sleeve, the gripping sleeve is held in the first position by a first compression spring and a second compression spring.

8. The connector according to claim 7, wherein the first and second compression springs each have a first end and a second end wherein the first end of the first compression spring and the first end of the second compression spring bear on a collar of the guide sleeve and the second end of the first compression spring and the second end of the second compression spring bear on the gripping sleeve, such that the first end of the first compression spring faces towards the first end of the second compression spring, and the second end of the first compression spring faces away from the second end of the second compression spring.

9. The connector according to claim 1, wherein the engagement element freely moves radially in a recess of the guide sleeve.

10. The electric connector coupling having the connector according to claim 1, and a coupler which has at least one engagement structure in which the engagement element of the connector engages in the locking position.

* * * * *